US008238808B2

(12) United States Patent
Boness et al.

(10) Patent No.: US 8,238,808 B2
(45) Date of Patent: Aug. 7, 2012

(54) METHOD OF ENSURING A CORRECT LATERAL REGISTRATION SETTING AND PRINTING MACHINE SUITABLE THEREFOR

(75) Inventors: Jan D. Boness, Bad Bramstedt (DE); Ingo K. Dreher, Kiel (DE); Stefan Schrader, Kiel (DE); Nikolai Neefe, Hohenfelde (DE); Ralph Petersen, Luetjenburg (DE); Bernhard G. Steuernagel, Daenischenhagen (DE); Matthias Prinz, Felde (DE); Karlheinz Peter, Molfsee (DE); Norbert Freyer, Altenholz (DE)

(73) Assignee: Eastman Kodak Company, Rochester, NY (US)

( * ) Notice: Subject to any disclaimer, the term of this patent is extended or adjusted under 35 U.S.C. 154(b) by 446 days.

(21) Appl. No.: 12/299,638

(22) PCT Filed: Apr. 10, 2007

(86) PCT No.: PCT/EP2007/003159

§ 371 (c)(1),
(2), (4) Date: Nov. 5, 2008

(87) PCT Pub. No.: WO2007/131580

PCT Pub. Date: Nov. 22, 2007

(65) Prior Publication Data

US 2009/0196662 A1 Aug. 6, 2009

(30) Foreign Application Priority Data

May 12, 2006 (DE) ..... 10 2006 022 753

(51) Int. Cl.
*G03G 15/00* (2006.01)

(52) U.S. Cl. ..... 399/394; 399/303; 399/313

(58) Field of Classification Search ..... 399/312, 399/313, 303, 301, 394, 395, 165; 347/116
See application file for complete search history.

(56) References Cited

U.S. PATENT DOCUMENTS

| | | | | |
|---|---|---|---|---|
| 5,021,676 | A | 6/1991 | Dragon et al. | 250/559.37 |
| 5,510,877 | A * | 4/1996 | deJong et al. | 399/165 |
| 6,335,748 | B1 | 1/2002 | Furst | 347/116 |
| 2006/0285903 | A1 * | 12/2006 | Yamane et al. | 399/394 |

FOREIGN PATENT DOCUMENTS

EP 1375167 1/2004

* cited by examiner

*Primary Examiner* — Sophia S Chen

(57) ABSTRACT

The invention relates to a method of ensuring a correct lateral registration setting, in a digital multi-color electrographic sheet-printing machine, which the sheets adhere to a support, preferably a transport belt, are transported past printing units.

7 Claims, 1 Drawing Sheet

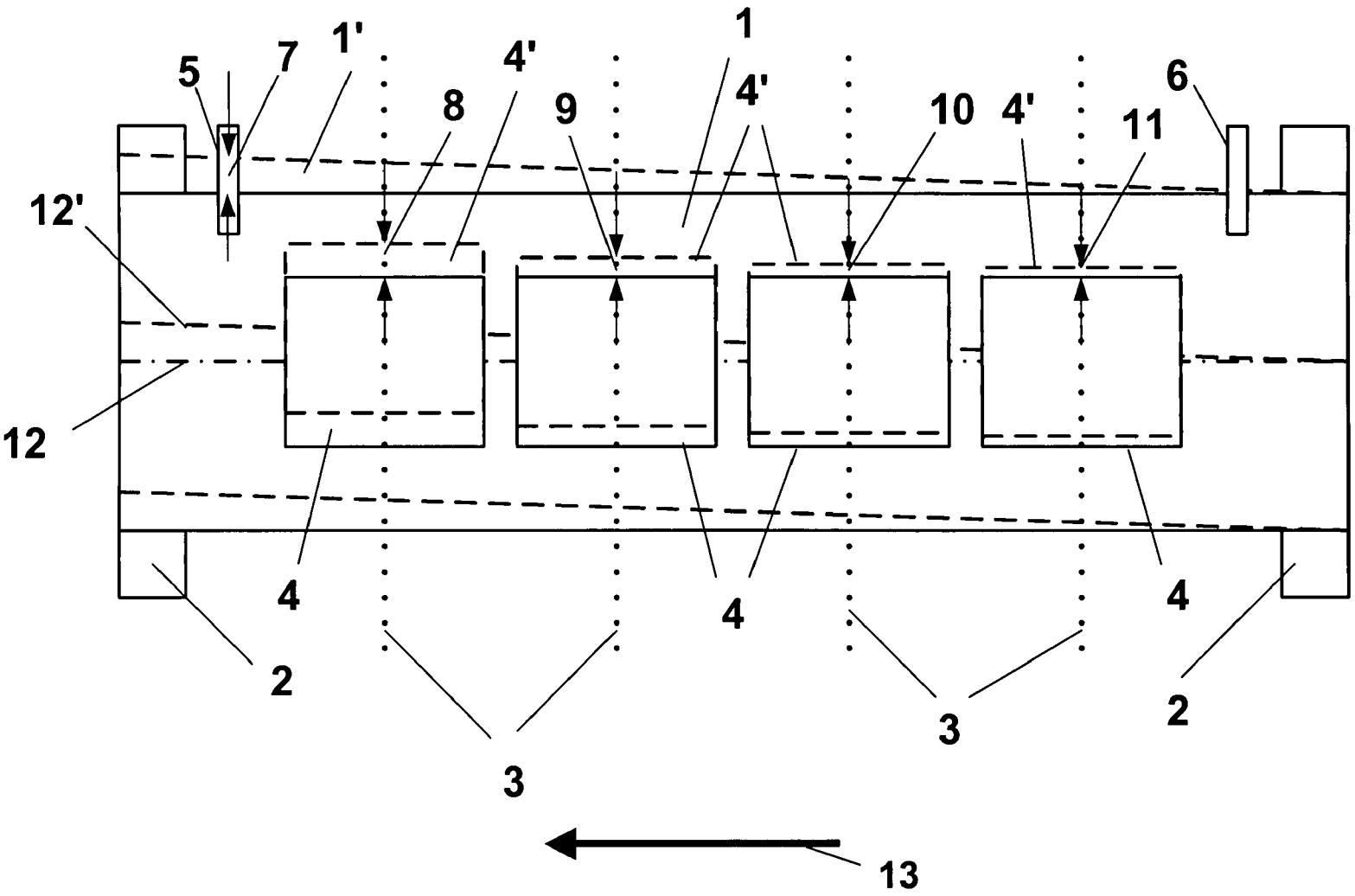
6
11
4'
10
1
4'
9
4'
8
1'
7
5
12'
12
2
4
3
4
3
4
2
13

METHOD OF ENSURING A CORRECT LATERAL REGISTRATION SETTING AND PRINTING MACHINE SUITABLE THEREFOR

The invention relates to a method of ensuring a correct lateral registration setting, preferably in a digital multi-color sheet-printing machine, in particular during a printing process, preferably in an electrophotographically operating printing machine, in which the sheets adhering to a support, preferably a transport belt, are transported past printing units.

In addition, the invention relates to a printing machine, preferably for carrying out said method, said machine comprising a support for transporting the sheets that are to be printed and that adhere to said support, preferably electrostatically, through at least one section of the printing machine equipped with printing units, preferably a digital multi-color printing machine, preferably an electrophotographically operating printing machine.

During each printing operation, accurately aligned and/or registered printing is extremely important for the quality of the resultant printed image and, in fact, represents a measurement of quality of the printing machine.

Even a single-color printed image must be placed correctly, in particular, centrally aligned on the sheet to be printed, i.e., show a correct image area. In multi-color printing, it is additionally very important that the individual printed images of the respective color separations be printed in a precisely superimposed manner, in order to avoid, for example, differently colored fringes on the printed image. In particular, in an electrophotographic printing machine, either a latent printing image, for example, using an LED write head, must be precisely positioned and exposed onto a photoconductor (image to sheet) in a pixel-specific manner—i.e., for example, with an accuracy of 42.5 μm—relative to the arriving sheet to be printed, or the arriving sheet must be supplied appropriately accurately positioned and positionally corrected (sheet to image). But the exact positional correction of the sheet is generally more difficult, so that the exposure position correction might be preferable.

In any event, to achieve this, it is necessary to first detect the position of the sheet to be printed or, this being mostly possible with greater accuracy, to detect a potential position change of the sheet. In order to control the position of the sheet in transport direction, i.e., in the circumferential direction of a potentially involved printing cylinder, the usual determinations as to path, location and/or time are made. However, also the lateral transverse position of the sheet, in this case referred to as the lateral registration, must be correct.

In offset printing machines, sheets are in most cases transported by means of gripping systems. In particular in digital printing machines, the sheets are frequently transported on supports, preferably on transport belts. In this case, the sheets adhere—preferably over their entire area and without slipping, preferably in an electrostatic manner—to this support. This support, in particular, a rotating transport belt, is tensioned under normal circumstances and is thus relatively stable with respect to its position; however, the support can be subject to certain migrations, specifically skewing, in particular due to climatic changes such as, for example, temperature and humidity, or due to a changing toner application layer thickness, said migrations easily accounting for a lateral variation of approximately 200 μm.

The object of the invention is to provide a measure by means of which the lateral registration of the sheets can be checked, corrected and/or maintained in a simple manner.

Referring to the method, this object is achieved in accordance with the invention in that the lateral registration of the sheets is checked by checking the lateral travel of the support.

Inasmuch as the sheet adheres to the support and the sheet position on the support is known, the inventive measure can be used to check and ensure the lateral registration of the sheet in a simple and elegant manner.

This is done in that the travel of one lateral edge of the support is checked in two check sections which are arranged at a distance from each other in transport direction and each extend in a direction transverse to the transport direction. In this manner, a transverse migration and, in particular, also a skewing of the support can be noticed and determined exactly in a quantitative manner. Specifically, the check can be performed with line detectors. If required, marks may also be provided on the support, which marks can be better detected by the sensors, in particular, when the support itself is transparent.

One particular advantage of the invention is, as provided in accordance with a modification of the inventive method, that it is not the travel of the support that must be corrected for the lateral registration of the sheets—which, of course, is possible in accordance with the invention—but that, in order to ensure a correct lateral registration, the printed images can be positioned in the printing units matching the check of the support, this being even more precise and significantly less complex. This has the result that, preferably in an electrophotographically operating printing machine, the imaging of each individual photoconductor can occur, matching the check result of the support, in a precisely positioned pixel-specific manner (image to sheet).

Advantageously, the invention also provides options other than the above specified adjustments, whereby these adjustments can be performed, in particular, even while the print job is being processed and, preferably repeatedly at pre-specified time intervals.

Another, independent modification of the method of the invention advantageously provides that, by checking the lateral travel of the support during at least one test run of a printing machine, the most suitable operation of the support for a correct and stable lateral registration is determined and set up. In particular at the time of the initial installation, the printing machine can be set up and installed in such a manner that a minimum of fluctuations of the lateral registration of the sheets would have to be expected.

For an inventive printing machine, preferably for carrying out the inventive method, comprising a support for transporting the sheets that are to be printed and that adhere to said support, preferably electrostatically, through at least one section of the printing machine equipped with printing units, preferable a digital multi-color printing machine, preferably an electrophotographically operating printing machine, independent protection is also claimed for this independently achieved object, said printing machine being characterized in that, for the check of the lateral registration of the sheets, check elements for checking the lateral travel of the support are provided. The resultant advantages have already been basically described in the context of the inventive method.

One modification of the inventive printing machine provides, in particular, that check elements are arranged in two check sections, which are provided at a distance from each other in transport direction and which each extend in a direction transverse to the transport direction, in order to check the travel of one lateral edge of the support. The check elements may be line sensors that, for example, are potentially configured as a type of camera chips or as light barriers.

One embodiment, which could also result in additional inventive features, which, however, does not restrict the scope of the present invention, is shown by the drawing.

The only FIGURE shows a schematic plan view of a transport belt of an inventive printing machine.

The closed rotating transport belt 1 is deflected over deflecting rollers 2 and driven in a transport direction 13. The longitudinal center travel of the transport belt 1 is indicated in a chain line 12.

Printing units of a multi-color printing machine may be located above the transport belt, whereby the positions of said printing units are indicated in dotted lines 3, for example.

The sheets 4 are placed in an adhering manner on the transport belt 1 in order to pass the printing units 3, where they will be printed, in transport direction 13.

The travel of the lateral edge of the transport belt 1 is checked with the aid of line sensors 5, 6.

During the operation of the printing machine or already during its installation, the movement of the transport belt may be skewed as indicated by dashed lines 1' and by a dashed longitudinal center line 12'. This skewed travel is detected by means of the line sensors 5, 6. This skewed motion causes, in particular, a measurable transverse offset 7 in the region of the line sensor 5. This transverse offset 7 also gradually affects the sheets 4, 4' causing the transverse offsets 8, 9, 10, 11 in the regions of the printing units 3. These resultant transverse offsets 8, 9, 10, 11 can be computed with the use of the measurements provided by the line sensors 5, 6 based on the detected skew of the monitored lateral edge of the transport belt 1, 1'. Inasmuch as these transverse offsets 8, 9, 10, 11 can manifest themselves as lateral registration errors during the operation of the printing units 3, the expected lateral registration errors can be compensated with the use of the mentioned computations and can thus be avoided in that, in particular, the write heads of the printing units are arranged with the appropriate transverse offset and in a pixel-specific manner in order to also offset the printing image to match the offset 8, 9, 10, 11 of the respective sheet 4, 4', so that the image area is precisely maintained despite the skew of the transport belt 1, 1'.

By monitoring the travel of the transport belt 1 with the use of line sensors 5, 6, the printing machine could be set up—even at the time of its installation—in such a manner that skewing of the transport belt 1 is minimized, avoided or prevented in a consistent manner.

Following is another brief exemplary explanation of possible operational modes of an inventive printing machine:

If the lateral registration is properly adjusted by means of available electronic adjustment values ("center pixel" values of the LED write heads) and if the transport belt 1 takes the course drawn by the solid line, no lateral registration errors will occur. Changes with respect to machine temperature, toner coverage of the printing sheets 4, the weight per unit area of the sheets 4, etc., however, can lead to a changed direction of travel or position of the transport belt 1 (dashed course 1'), which has the result that the printing sheets 4 are subject to a transverse drift between the first printing unit and the last printing unit or module 3. However, because the first, as well as all the additional color separations continue to be printed in the same lateral position each time, lateral registration errors occur on the same order. Basically, the sheet 4 is always already subjected to a minimal transverse drift on its path from the loading and adhering station (not illustrated) for the electrostatic adhesion of the sheet 4 on the transport belt 1 to the first printing module; however, this transverse drift plays a subordinate role here because it ultimately causes slight lateral erroneous positioning of the entire printed image (image to sheet cross track), which is subject to much less restrictive specification limits than the lateral registration. The two transport belt position sensors 5, 6 are used to detect and quantify such a change of the transport belt position 1, 1'.

Inasmuch as the distance of the two transport belt position sensors 5, 6, as well as the distances of the printing units 3 from each other, are known, the lateral registration errors 8 through 11 of the individual colors can be computed based on these and then corrected, if necessary. This correction may occur for all the colors, either in an absolute manner or with respect to the first printing unit 3 (for example, the black color separation).

For another application, the change of the belt position (i.e., the sensitivity with respect to the stimulus) occurring with a pre-specified stimulus can be calibrated. This is used as the basis for installing the printing machine in such a manner that this sensitivity is minimized from the start and that thus good lateral registration is achieved—without regular correction—during the operation of the printing machine.

In the present embodiment, the belt position 1, 1', 12, 12' is defined by two points which are measured at the positions of the two belt position sensors 5, 6. With the use of these two points, the accurate direction in which the transport belt 1 moves through the printing machine is determined.

Various possibilities of a correction (preliminary control, adjustment) of the lateral registration during the ongoing printing process or of even only an automated adjustment procedure are conceivable in accordance with the invention, for example, and could be implemented from the viewpoint of acceptable effort, namely:

1. One-time adjustment—At the start of each print job the belt position is calibrated and compared with the last-determined values (e.g., the situation in which the lateral registration was last adjusted by the machine operator). The difference of the measurements is used to compute the change of the lateral registration by means of a geometric formula. As soon as the lateral registration error has reached a certain magnitude, it is corrected by an appropriate readjustment of the "center pixel" values of the write heads, and the belt position is stored as the new reference position. Corrections of the lateral registration are possible only in integral pixel steps, for example, 42.5 ||m.
2. Continuous correction—The measurement of the belt position and the correction of the lateral registration are performed repeatedly in fixed intervals during each print job.
3. Correction as a service routine—The calibration of the belt position and the corresponding correction of the lateral registration are performed independent of a print job as an independent, automatic or operator-initiated service routine.

In particular for methods 1. and 2., it is necessary to recognize when the machine operator manually adjusts the lateral registration so that the operator's corrections can be taken into account. As mentioned above, as a rule, an absolute automatic measurement of the lateral registration is not possible, so that a manual adjustment continues to be required at least for a starting point that is to be kept consistent. It has been found that relative humidity plays a subordinate role, however, temperature fluctuations result in noticeable lateral registration fluctuations. In addition, it has been discovered that a printing machine can be made lastingly insensitive to such temperature fluctuations by appropriate fine-tuning of the positions of the lower support points of the transport belt frame. Inasmuch as a machine that has been adjusted in this manner also displays lateral registration stability in view of changes regarding the application of toner to the printing sheets (and vice versa), the desensitization of the printing machine may occur during production, without requiring any reliance on time-consuming artificial temperature changes using an environmental test chamber.

The employed production process could be as follows:

A special calibration run is started, whereby the transport belt 1 is initially operated empty for a few rotations; then, for example, 110 sheets (for example, loading of 10 transport belt rotations) with low toner application and, directly thereafter, the same number of sheets with high toner application are printed. During these two printing sequences, the transport belt's position is measured and stored during each of its rotations as the difference of the respective measurements of the two belt position sensors 5, 6. Then, respectively one data point of the start and of the end of the two printing sequences is discarded in order to exclude transient effects. Finally, the mean is determined separately of the data range of the first printing sequence (little toner), as well as of the second printing sequence (much toner). Finally, the "toner sensitivity" results as the difference between these two mean values (ideal case: zero). Based on the determined value, it is possible to exactly state the amount (typically within the range of +/−1 mm in increments of, e.g., 0.254 mm) by which the support point of the transport belt frame needs to be shifted in order to make the lateral registration of this printing machine insensitive to fluctuations of temperature or toner application. Thereafter, the support points are fixed in position.

The invention claimed is:

1. Method of ensuring a correct lateral registration setting, in a digital multi-color electrographic sheet-printing machine, in which sheets adhere to a support when transported past one or more printing units such that the lateral registration of the sheets is checked by checking the lateral travel of the support wherein a sensitivity of the support to lateral registration errors occurring with a prespecified stimulus is reduced by calibration of an initial support position based upon test runs made with the stimulus at different intensities.

2. Method as in claim 1, wherein the travel of one lateral edge of the support is checked in two check sections which are arranged at a distance from each other in a transport direction and each extend in a direction transverse to the transport direction.

3. Method as in claim 1, said checking of the lateral transport in order to ensure a correct lateral registration, comprising printed images in the printing units to match the check of the support.

4. Method as in claim 1, further comprising checking the lateral travel of the support during at least one test run of a printing machine, the most suitable operation of the support for a correct and stable lateral registration is determined and set up.

5. A printing machine, for printing, said machine comprising a support for transporting sheets that are to be printed and that adhere to said support, preferably electrostatically, through at least one section of the printing machine equipped with printing units, preferably an electrophotographically operating printing machine, wherein checking of the lateral registration of the sheets comprises check elements for checking the lateral travel of the support wherein a sensitivity of the support to lateral registration errors occurring with a prespecified stimulus is reduced by calibration of an initial support position based upon test runs made with the stimulus at different intensities.

6. Printing machine as in claim 5, wherein said check elements are arranged in two checks sections, which are provided at a distance from each other in transport direction and each extend in a direction transverse to the transport direction, in order to control the travel of one lateral edge of the support.

7. Printing machine as in claim 5 wherein the check elements are line sensors.

* * * * *